United States Patent [19]

Syassen

[11] Patent Number: 4,787,350

[45] Date of Patent: Nov. 29, 1988

[54] DUAL-INJECTION METHOD AND DEVICE FOR SELF-IGNITING INTERNAL COMBUSTION ENGINES

[75] Inventor: Ing. Ono Syassen, Hemsbach, Fed. Rep. of Germany

[73] Assignee: Kloeckner-Humboldt-Deutz AG, Fed. Rep. of Germany

[21] Appl. No.: 92,889

[22] Filed: Sep. 4, 1987

[30] Foreign Application Priority Data

Sep. 6, 1986 [DE] Fed. Rep. of Germany ..... 3630439

[51] Int. Cl.[4] ..... F02M 45/06

[52] U.S. Cl. ..... 123/300; 123/447

[58] Field of Search ..... 123/299, 300, 447, 449, 123/450, 457, 458, 510, 446

[56] References Cited

U.S. PATENT DOCUMENTS

| | | | |
|---|---|---|---|
| 2,356,627 | 8/1944 | Skaredoff | 123/300 X |
| 3,818,882 | 6/1974 | Leonov et al. | 123/447 |
| 4,222,358 | 9/1980 | Hofbauer | 123/495 |
| 4,378,775 | 4/1983 | Straubel et al. | 123/446 X |
| 4,425,885 | 1/1984 | Tanaka et al. | 123/299 |
| 4,572,136 | 2/1986 | Takeuchi et al. | 123/447 |
| 4,574,759 | 3/1986 | Leblanc | 123/450 |
| 4,627,403 | 12/1986 | Matsumura | 123/447 |

FOREIGN PATENT DOCUMENTS

| | | | |
|---|---|---|---|
| 24803 | 3/1981 | European Pat. Off. | 123/299 |

*Primary Examiner*—Tony M. Argenbright

*Attorney, Agent, or Firm*—Charles L. Schwab

[57] ABSTRACT

Apparatus and method for injecting fuel into at least one self-igniting internal combustion engine (1), wherein the injection process is divided into a preliminary injection and a primary injection. The total length of time of the injection is relatively brief in spite of the dual injection. In order to accomplish this, the preliminary pressure generated by a preliminary pressure pump is at least 10 bar and the ratio of the high pressure to the preliminary pressure is less than 80.

13 Claims, 1 Drawing Sheet

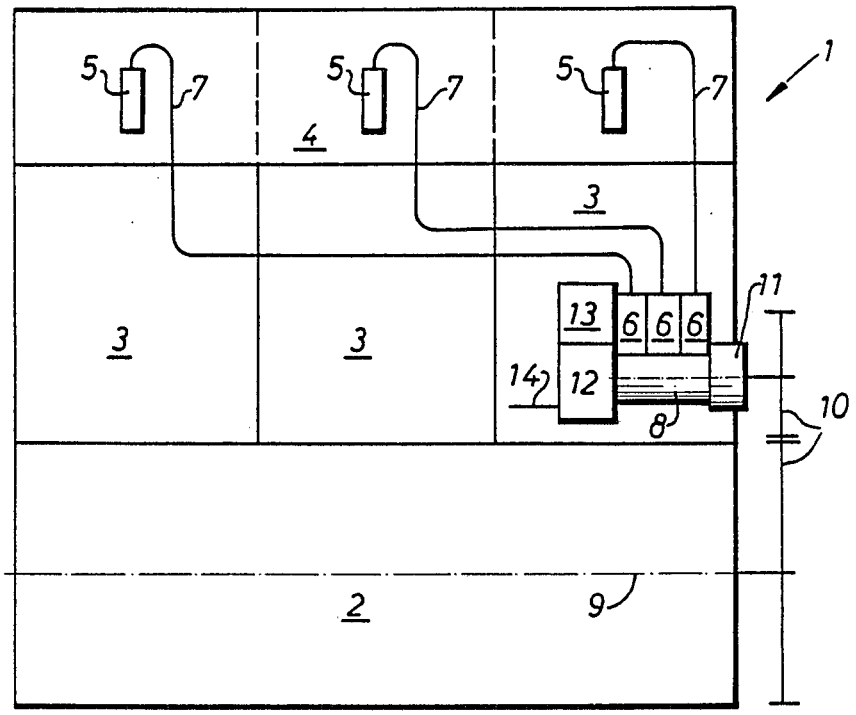
1
2
3
3
3
4
5
5
5
6
6
6
7
7
7
8
9
10
11
12
13
14

DUAL-INJECTION METHOD AND DEVICE FOR SELF-IGNITING INTERNAL COMBUSTION ENGINES

TECHNICAL FIELD

This invention relates to a fuel injection system for diesel engines and particularly to a fuel injection system which includes preliminary injection.

PRIOR ART STATEMENT

It is known that initial injection of fuel in a diesel engine begins shortly before or at the beginning of the power stroke. The combustion of the injected fuel requires a specific period of time with a specified condition of the compressed air trapped in the combustion chamber, during which additional fuel is added by injection. The initiation of ignition of the preliminary injection quantity results because a quantity of fuel which has already been injected by the time ignition occurs and thus the fuel is ignited very quickly and burns "suddenly." This sudden combustion, which is accompanied by a rapid increase in combustion pressure relative to the angle of the crank shaft, represents a substantial cause for the knocking noise which is typical for diesel engines.

Suggestions for designs which are more favorable with respect to the injection sequence which is responsible for the knocking diesel noise are known in the following characteristic forms.

One suggestion which has been known for some time consists of interrupting the injection shortly after it has been initiated, so that it can anticipate the self-ignition of the small quantity of the preliminary injection and only then inject the primary injection amount into the already burning amount of preliminary injection fuel. This procedure is, however, technically difficult, cumbersome and expensive because it requires in its original form an additional second complete injection system and a second regulating system, which optimizes the assignment of injection time spans and quantities according to load and speed.

There are in addition procedures with only one injection pump for the preliminary and primary injections, but they have two injection nozzles per cylinder. Here a partial quantity of fuel—the preliminary injection amount—which is prestored after the last injection is injected via a mechanical or hydraulic pressure divider system. This procedure is also relatively costly because of the required second injection nozzle and the pressure divider system. It is not possible to optimally assign both the times and quantities of the injections according to load and speed. In addition, major problems arise because the independence of the small preliminary injection nozzle causes coal carbonization because of its comparably smaller fuel flow rate. Also, the spatial arrangement of two injection nozzles within the cylinder head of an internal combustion engine is problematic because there is no optimal position available for forming the combustion mixture when two injection nozzles are used.

In another embodiment, the suggestion is made that preliminary and primary injection of fuel be provided by using only one injection pump and one injection nozzle, as well as an additional interruption device in the form of a second stop borehole in the injection pump piston guide, and/or with the aid of an alternative piston-nozzle holder or a similar device.

In a similar way the preliminary and primary fuel amounts are injected into the combustion chamber of the internal combustion engine using the invention described in EP-A No. 0024 803. The high pressure pump is supplied with fuel by a preliminary pressure pump, whereby the fuel pressure which is generated by the preliminary pressure pump amounts to 2.5 bar (1 bar $=10^6$dyn/cm$^2=1.01972$ atmospheric pressure). In order to inject the fuel into the combustion chamber, the high pressure pump increases the fuel pressure to the required injection pressure, which is approximately 700 bar with an injection nozzle opening pressure of approximately 300 bar. As a result the pressure ratio of high pressure to preliminary pressure is in the area of about 280.

However, this design has the disadvantage that the small preliminary injection amount is already being injected at the beginning of the increase in pressure after exceeding the discharge pressure. This means the preliminary injection is carried out when the level of injection pressure is still relatively low vis-a-vis the relatively broad injection nozzle cross-sections of the injection nozzles which are laid out to conform to the principal amount which is to be injected. The fuel dispersion is thus only moderately fine and relatively inexact. The total injection process is thus to a relatively great extent lengthened because two pressure build-up periods and two interruptions of the injection are required. The resultant combustion is thus in need of improvement in terms of quality and degree of efficiency.

The quality of the dispersion can be fundamentally and substantially improved by an increase in the injection pressure. This general tendency which is also known is greatly limited by the technical problems involved in generating high individual pressure strokes. Here the phases of the pressure build-up before the beginning of the injection and the pressure decrease at the end of the injection are not entirely satisfactory.

In addition, the so-called constant pressure system is known, with which the fuel is kept under high pressure in an accumulator and is injected directly into the combustion chamber by means of an injection valve which is controlled electromagnetically or hydraulically. Realizing a dual injection with a constant pressure system of this type would be favorable as regards the injection process, but can only be realized at a considerably expense because of the high technical investment required and the technical problems which arise at present in controlling this sort of short time span injection valve.

OBJECTS AND SUMMARY OF THE INVENTION

A main object of this invention is to decrease the knocking noise of a self-igniting internal combustion engine, which also improves the combustion efficiency thereby improving fuel consumption and improving the quality of exhaust emissions.

The object is met in that the preliminary pressure generated by the preliminary pressure pump amounts to at least 10 bar and the ratio of high pressure to preliminary pressure is limited to 80 as the highest value. If the boundary conditions remain with respect to the discharge pressure, the time needed for pressure build-up is decreased to a fraction of the original time. When using the maximum allowable 80 to one pressure ratio, the pressure at the time of injection is increased to at least 800 bar. The following advantages and benefits are achieved by operating within these two parameters which complement each other:

A finer dispersion of the injection streams is achieved through the increase in discharge pressure. This is especially advantageous for the preliminary injection phase.

Well-dispersed, very small preliminary injection quantities can be delivered to achieve low combustion-related noise.

The total time span needed for the injection is shortened to a relatively short total time span from the beginning of the preliminary injection until the end of the primary injection in order to achieve a good conversion of fuel to power.

The time gap between the preliminary injection and the primary injection can be reduced by the faster and better preparation of the mixture as well as by the more rapid ignition which results from the finer dispersion.

The minimum time gap between the preliminary injection and primary injection can be achieved by shortening the time for the pressure build-up and pressure decrease phases by means of decreasing the pressure difference between the discharge pressure and preliminary pressure. In addition, the pressure decrease at the end of the preliminary injection and renewed pressure build-up at the beginning of the primary injection takes up too much time for an optimal dual-phase injection procedure with the known injection procedures. With a relatively high preliminary injection pressure level less time is required for the build-up of pressure of injection and for the decreases in pressure between the preliminary and primary injection cycles.

A decrease in exhaust gas emission (especially nitric oxide) is attained through being able to set the beginning of the injection later within a relatively short total injection time (resulting from the higher injection rates) in order to thus diminish the highest pressure and the highest temperature in the combustion process which encourages the formation of nitric oxide.

Alternatively, a decrease in exhaust emission (nitric oxide) is also made possible by an equally late initiation of injection, this being made possible by a reduction in the total injection time by high injection rates which result from the high intermediate injection pressure without a non-acceptable decline in the conversion of fuel to power.

An improvement in the operational performance at the lowest speed range and extending the idling speed range to lower idling speeds is made possible.

The start behavior and high-speed behavior of the internal combustion engine is improved when the hydrocarbon emissions are decreased.

In this invention the fuel for the preliminary injection and the primary injection is advantageously injected into the combustion chamber of each cylinder via an injection nozzle which is supplied with fuel by a high pressure pump. Although it may be possible to provide two completely separated injection systems or one high pressure pump and two injection nozzles, such arrangements would result in higher construction expenses per cylinder. An object of this invention is to provide the high pressure pump(s) with fuel at a high preliminary pressure so as to achieve satisfactory preliminary and primary injection.

It is advantageous for the preliminary pressure which is generated by the preliminary pressure pump to be at least 100 bar. A preliminary pressure at this level makes it possible to have a short pressure build-up period to primary injection. In addition, primary injection pressures of 1000 bar or more are made possible with such an increased preliminary pressure with a very low pressure ratio between "high pressure/preliminary pressure" and correspondingly short pressure strokes.

In performing the injection method of this invention the preliminary pressure pump is adjusted to generate a fuel delivery pressure as high as 100 bar or more, but at least 10 bar.

Preferably the preliminary pressure pump and the high pressure pump are integrated into a single pump unit. The purpose of the preliminary pressure pump is to supply the high pressure pump with fuel. In a compactly constructed integrated pump unit, the conveyance of fuel from the preliminary pressure pump to the high pressure pump is free of problems attendant the use of high pressure connecting lines which are necessary with a remote preliminary pressure pump. The invention is advantageously used in both in-line pumps, for which the high pressure pump pistons for the individual cylinders are combined in one casing unit, and in distributor pumps. Using the invention with individual injection pumps (unit injectors) is different. In such case the use of one preliminary pressure pump (or, with V-engines, two) and a preliminary pressure system is recommended. In a unit injector system, appropriate high pressure connecting lines are necessary between the preliminary pressure pump and the individual injection pumps at the cylinders because of the spatial separation of the individual injection pumps from one another and from the preliminary pressure pump.

In one embodiment of the invention, at least one high pressure storage chamber or vessel is operatively interposed between the preliminary pressure pump and the high pressure pump, permitting the high pressure in the high pressure storage vessel to be generated mechanically, hydraulically or pneumatically, independently of the high pressure pump. In such embodiment, the preliminary pressure pump handles only the supplying of fuel for the high pressure storage vessel while the high pressure in the vessel is generated independently by a mechanical, hydraulic, or pneumatic pressure system. A design of this type is advantageous during starting of the internal combustion engine because the storage vessel is already pressurized, as for instance by an air pressure tank, at the time the engine is started. Such a design also improves the high-speed performance of the internal combustion engine. Depending on the design of the internal combustion engine, it can be advantageous to integrate two or more high pressure vessels into the injection system. These can then be placed under pressure independently of each other by pressure systems. Preferably, internal combustion engines which are provided with high pressure storage vessels designed in this way are used with all vehicles or construction machinery for which a hydraulic or pneumatic pressure system is required, as is the case, for example, with agricultural vehicles and excavators, in which case the available pressure system need only be appropriately tapped and controlled to generate the high pressure in the high pressure storage vessel.

In another embodiment of the invention an accumulator can be hydraulically connected between the preliminary pressure pump and the higher pressure pump. The use of an accumulator reduces the pressure fluctuations in the fuel delivered to the high pressure pump. In this embodiment a pressure regulating valve is arranged between the preliminary pressure pump and the high pressure pump at the accumulator, or within the flow connection, which regulates the pressure of fuel in the accumulator, to predetermined values. The regulating valve may be of a design to maintain a relatively constant pressure level. In addition, check valves are placed in an advantageous way in the inlet and outlet lines to and from the accumulator. The check valves guarantee that the specified or predetermined fuel pressure is also maintained in the accumulator when the internal combustion engine is not running. Thus the fuel which is kept under high pressure in the accumulator is immediately available to the high pressure pump when the internal combustion engine is started up, which simplifies engine start-up and acceleration to operating speed.

In another embodiment of the invention, the quantity delivered to the preliminary pressure pump is variable. That is, the quantity delivered by the preliminary pressure pump can be altered directly, depending on the pressure which exists in the accumulator. With this arrangement it is possible for the preliminary pressure pump to deliver the quantity needed by the high pressure pump at a particular time. The quantity delivered may be regulated by, for example, altering the speed of the preliminary pressure pump; this procedure being appropriate, for instance, when using a gear pump as the preliminary pressure pump.

BRIEF DESCRIPTION OF THE DRAWING

One embodiment of the invention is illustrated by the schematic drawing of a diesel engine and its fuel injection system.

DETAILED DESCRIPTION OF THE DRAWING

Referring to the drawing, an internal combustion engine 1 includes a crank casing 2, several cylinders 3, and a cylinder head 4. The cylinder head 4 can also be divided into several separate cylinder heads, according to the number of cylinders. The invention is useful in internal combustion engines of various configurations such as one-, two-, or four-cylinder engines, or a "V-engine."

Injection nozzles are installed in nozzle holders 5 in the cylinder head 4, one for each of the cylinders 3. Here an additional interruption device is built into the injection nozzles and/or into the nozzle holders 5, respectively, in the form of a pressure breaker or an alternate piston (AWK-nozzle holder) or, for example, a second, height-displaced stop borehole. Through this device and/or design the injection process is easily subdivided into a preliminary and primary injection without the use of additional injection nozzles, injection lines, or injection pumps. The preliminary and primary injection can, of course, be carried out in other ways, as has been previously described.

High pressure piston pumps 6 are installed in series on a casing or in-line pump block. The outlet openings of the high pressure pumps 6 are connected by means of injection lines 7 with the nozzle holders 5. The pistons of the high pressure pumps 6 are reciprocated by a cam shaft 8, which is installed in the common pump casing for the high pressure pumps 6. The cam shaft 8 is driven by a crank shaft 9 of the internal combustion engine 1 by means of a gear unit 10. On the drive side, a timing mechanism 11 is arranged ahead of the high pressure pumps 6, by which the initiation of injection of the high pressure pumps 6 can be adjusted depending on, for instance, the speed of the internal combustion engine. As an extension to the high pressure pumps 6, a preliminary pressure pump 12 and an accumulator 13 are integrated as a unit into the casing of the high pressure pumps 6.

By means of an inlet line 14, fuel flows from a storage tank, not shown, via a fuel filter, not shown, to the preliminary pressure pump 12 which pressurizes the fuel to a pressure of at least 100 bar.

The fuel, thus pressurized, is delivered to an accumulator 13, which in turn is connected with the high pressure pumps 6. In the accumulator, the pressure fluctuations which are caused by the preliminary pressure pump 12 are substantially eliminated. In addition, check valves are inserted in the inlet and outlet of the accumulator 13, which ensure that the desired preliminary pressure of the fuel in accumulator 13 is maintained when the internal combustion engine is not running. From the accumulator 13, the fuel is delivered to the high pressure pumps 6, which increase the pressure of the fuel to a predetermined injection pressure level. The fuel thus pressurized to a high pressure by the pumps 6 is delivered via the injection lines 7 to the injection nozzles arranged within the nozzle holders 5, which inject the fuel into the combustion chambers of the internal combustion engine 1 as a result of an interruption device, which may consist of, among other things, a pressure divider or alternate pistons in the nozzle holders 5 or in the stop boreholes placed in the injection nozzle in the piston guide. Preliminary injection quantities and the time span of the preliminary injection can thus be freely chosen. Using this invention, they can be very small.

The embodiments of the invention in which an exclusive property or privilege is claimed are defined as follows:

1. A device for injecting fuel into a combustion chamber of a self-igniting internal combustion engine (1), wherein the injection process is subdivided by a high pressure fuel pump (6) into a preliminary injection and a primary injection, and fuel is delivered to the high pressure pump (6) by a preliminary pressure fuel pump (12), characterized by: at least one high pressure storage vessel operatively interposed between the preliminary pressure fuel pump (12) and the high pressure fuel pump (6) and so constructed and arranged as to permit its pressurization to a predetermined high pressure independently of said preliminary pressure fuel pump (12).

2. A device of claim 1 wherein said preliminary pressure fuel pump (12) delivers a variable quantity of fuel.

3. A device for injecting fuel into a combustion chamber of a self-igniting internal combustion engine (1) including a high pressure fuel pump (6) operable to deliver a preliminary injection and a primary injection and a preliminary pressure fuel pump (12) operable to deliver fuel to said high pressure fuel pump (6) characterized by: said preliminary pressure fuel pump (12) is adjustable to deliver fuel at pressures in the pressure range of ten to one hundred bar and wherein an accumulator (13) is operatively interposed between said preliminary pressure fuel pump (12) and said high pressure fuel pump (6) whereby said accumulator (13) is in fuel receiving relation to said preliminary pressure fuel pump (12) and is in fuel delivery relationship to said high pressure fuel pump.

4. The device of claim 3 wherein said preliminary pressure fuel pump (12) delivers a variable quantity of fuel.

5. The device of claim 3 wherein said preliminary pressure fuel pump (12) and said high pressure fuel pump (6) are integrated into a single unit.

6. The device of claim 3 and further comprising pressure regulating means maintaining the pressure in said accumulator (13) between predetermined values.

7. The device of claim 6 wherein the quantity of fuel delivered by said preliminary pressure fuel pump (12) is adjusted in response to the pressure in said accumulator (13).

8. The device of claim 6 wherein said high pressure fuel pump (6), said preliminary pressure fuel pump and said accumulator (13) are integrated into a single unit.

9. A device for injecting fuel into a combustion chamber of a diesel engine (1) including a high pressure fuel pump (6) operable to deliver fuel at high pressure to an injection nozzle in both preliminary and primary injection quantities, a preliminary pressure fuel pump (12) operable to supply fuel under a preliminary pressure for said high pressure fuel pump (6), an accumulator (13) connected in fuel receiving relation to said preliminary pressure fuel pump (12) and in fuel delivery relation to said high pressure fuel pump (6) and means maintaining the ratio of said high pressure and said preliminary pressure at less than 80 and maintaining said preliminary pressure at a value of at least 10 bar.

10. The device of claim 9 wherein said pumps (6, 12) and accumulator (13) are an integrated unit.

11. The device of claim 9 and further comprising pressure regulating means operatively associated with said accumulator (13) operable to maintain the pressure therein within a predetermined pressure range.

12. The device of claim 11 wherein said preliminary pressure fuel pump (12) varies its delivery of fuel to said accumulator (13) in response to the pressure in the latter.

13. A device for injecting fuel into a combustion chamber of a self-igniting internal combustion engine (1) comprising: a pump casing, a drive shaft (8), a high pressure fuel pump (6) driven by said drive shaft and operable to deliver a preliminary injection and a primary injection, an accumulator (13) and a preliminary pressure fuel pump (12) operable to deliver fuel to said accumulator (13) at a pressure of at least 10 bar, said accumulator (13) being spaced from said drive shaft (8) and operatively interposed between said preliminary pressure fuel pump (12) and said high pressure fuel pump (6) whereby said accumulator (13) is in fuel receiving relation to said preliminary pressure fuel pump (12) and is in fuel delivery relationship to said high pressure fuel pump, said drive shaft (8), accumulator (13) and pumps (6, 12) being incorporated in said casing to form an integrated unit.

* * * * *

UNITED STATES PATENT OFFICE

CERTIFICATE OF CORRECTION

Patent No. 4,787,350 Dated November 29, 1988

Inventor(s) Ing. Ono Syassen

It is certified that error appears in the above-identified patent and that said Letters Patent is hereby corrected as shown below:

On the title page, item [73]:

The Assignee of this invention should be corrected to read:

Motoren-Werke Mannheim AG
Federal Republic of Germany

Signed and Sealed this

Sixth Day of July, 1993

*Attest:*

Michael K. Kirk

MICHAEL K. KIRK

*Attesting Officer*

*Acting Commissioner of Patents and Trademarks*